US007009160B2

(12) United States Patent
Han et al.

(10) Patent No.: US 7,009,160 B2
(45) Date of Patent: Mar. 7, 2006

(54) RACK FOR MICROWAVE OVENS, AND MICROWAVE OVEN SET EQUIPPED WITH THE SAME

(75) Inventors: Dae-Sung Han, Hwasung (KR); Yong-Woon Han, Kunpo (KR); Seong-Deog Jang, Suwon (KR); Han-Seong Kang, Suwon (KR); Joo-Yong Yeo, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 38 days.

(21) Appl. No.: 10/351,996

(22) Filed: Jan. 28, 2003

(65) Prior Publication Data

US 2004/0040957 A1 Mar. 4, 2004

(30) Foreign Application Priority Data

Aug. 29, 2002 (KR) ..... 2002-51317

(51) Int. Cl.
*H05B 6/64* (2006.01)
*F24L 15/16* (2006.01)

(52) U.S. Cl. ..... 219/763; 126/337

(58) Field of Classification Search ..... 219/763, 219/756, 757, 758, 759, 760, 761, 762; 126/337, 126/332, 273

See application file for complete search history.

(56) References Cited

U.S. PATENT DOCUMENTS

| | | | | | |
|---|---|---|---|---|---|
| 4,954,680 | A * | 9/1990 | Takenouchi | 219/763 |
| 5,270,511 | A * | 12/1993 | Iguchi | 219/667 |
| 5,491,323 | A * | 2/1996 | Mori et al. | 219/710 |
| 5,726,428 | A * | 3/1998 | Christensen | 219/754 |
| 5,842,287 | A * | 12/1998 | Murphy | 34/202 |
| 5,938,968 | A * | 8/1999 | Ogg et al. | 219/763 |
| 6,403,937 | B1 * | 6/2002 | Day et al. | 219/681 |
| 6,617,554 | B1 * | 9/2003 | Moon et al. | 219/481 |

FOREIGN PATENT DOCUMENTS

| | | |
|---|---|---|
| JP | 2001-116263 | 4/2001 |
| KR | 1999-23554 | 7/1999 |

* cited by examiner

*Primary Examiner*—Daniel Robinson
(74) *Attorney, Agent, or Firm*—Staas & Halsey LLP

(57) ABSTRACT

A rack for a microwave oven capable of appropriately cooking food without burning the food, and a microwave oven set equipped with the rack includes a rack section to support the food thereon, and support sections to support the rack section. The rack section includes a plurality of hollow tubes and a hollow net tube. A liquid may be received in the hollow tubes and the hollow net tube. Accordingly, food is cooked without being burnt even when cooking is performed in a microwave oven using heat radiated from a heater.

26 Claims, 5 Drawing Sheets

RACK FOR MICROWAVE OVENS, AND MICROWAVE OVEN SET EQUIPPED WITH THE SAME

CROSS-REFERENCE TO RELATED APPLICATION

This application claims the benefit of Korean Application No. 2002-51317, filed Aug. 29, 2002, in the Korean Intellectual Property Office, the disclosure of which is incorporated herein by reference.

BACKGROUND OF THE INVENTION

1. Field of the Invention

The present invention relates to a rack for microwave ovens, and more particularly, to a rack configured to contain therein a liquid to prevent food from being burnt at regions where the food is supported by the rack, and a microwave oven set equipped with the rack.

2. Description of the Related Art

Generally, a traditional microwave oven is an appliance to cook food using microwaves. That is, water molecules contained in food are vibrated while rotating in the microwave oven when they are subject to microwaves irradiated into a cooking chamber where the food is placed. Frictional heat is generated among the water molecules to thereby cook the food. Recently, microwave ovens of a new concept have been used and provide a new cooking function in addition to the traditional cooking function carried out by microwaves. For example, a grill-type microwave oven including a heater adapted to provide a food baking function, and a convection-type microwave oven including a fan adapted to convect hot air have been used.

FIG. 1 illustrates a microwave oven 100 having a function to radiate heat onto food to cook the food, and a rack 103 to support the food thereon. The microwave oven 100 also includes a door 104, a cooking chamber 101 selectively openable by the door 104, and a heater 102 rotatably installed in the cooking chamber 101. The rack 103 includes a plurality of spaced rack bars 103*a* adapted to support food thereon, and a plurality of legs 103*b* adapted to space the rack bars 103A apart from a bottom of the cooking chamber 101 by a desired distance. Typically, the rack bars 103*a* are made of iron and plated with a nickel or chromium film.

Where a cooking procedure is to be carried out using the microwave oven 100 equipped with the rack 103 by radiating heat onto food, the heater 102 is first rotated in a direction indicated by an arrow, as shown in FIG. 1. Thereafter, the rack 103 is disposed in the cooking chamber 101. The food to be cooked is then placed on the rack bars 103*a* of the rack 103. The microwave oven 100 is thereby operated to cook the food.

Where food is cooked in a state in which it is placed on the conventional rack 103, the rack bars 103*a* of the rack 103 receive the heat generated to be radiated onto the food in accordance with an operation of the heater 102. There may exist excessive heat because each of the rack bars 103*a* is made of an iron bar plated with a nickel or chromium film, thereby causing the food to be burnt at portions which contact the rack bars 103*a*. Such a phenomenon may occur particularly where the food to be cooked is fish.

SUMMARY OF THE INVENTION

Accordingly, it is an aspect of the present invention to provide a rack for a microwave oven to prevent food from being burnt even when the food is cooked using heat radiated from a heater provided in the microwave oven, and a microwave oven set equipped with the rack.

Additional aspects and advantages of the invention will be set forth in part in the description which follows and, in part, will be obvious from the description, or may be learned by practice of the invention.

The foregoing and other aspects of the present invention are achieved by providing a rack for a microwave oven including a rack section to support food thereon. The rack includes support sections to support the rack section, and is disposed in a cooking chamber defined in the microwave oven. The food supported by the rack section is to be cooked in accordance with an operation of a heater equipped in the microwave oven. The rack section includes a plurality of hollow tubes able to contain a liquid. Alternatively, the rack section includes a hollow net tube able to contain a liquid.

BRIEF DESCRIPTION OF THE DRAWINGS

The above and other aspects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
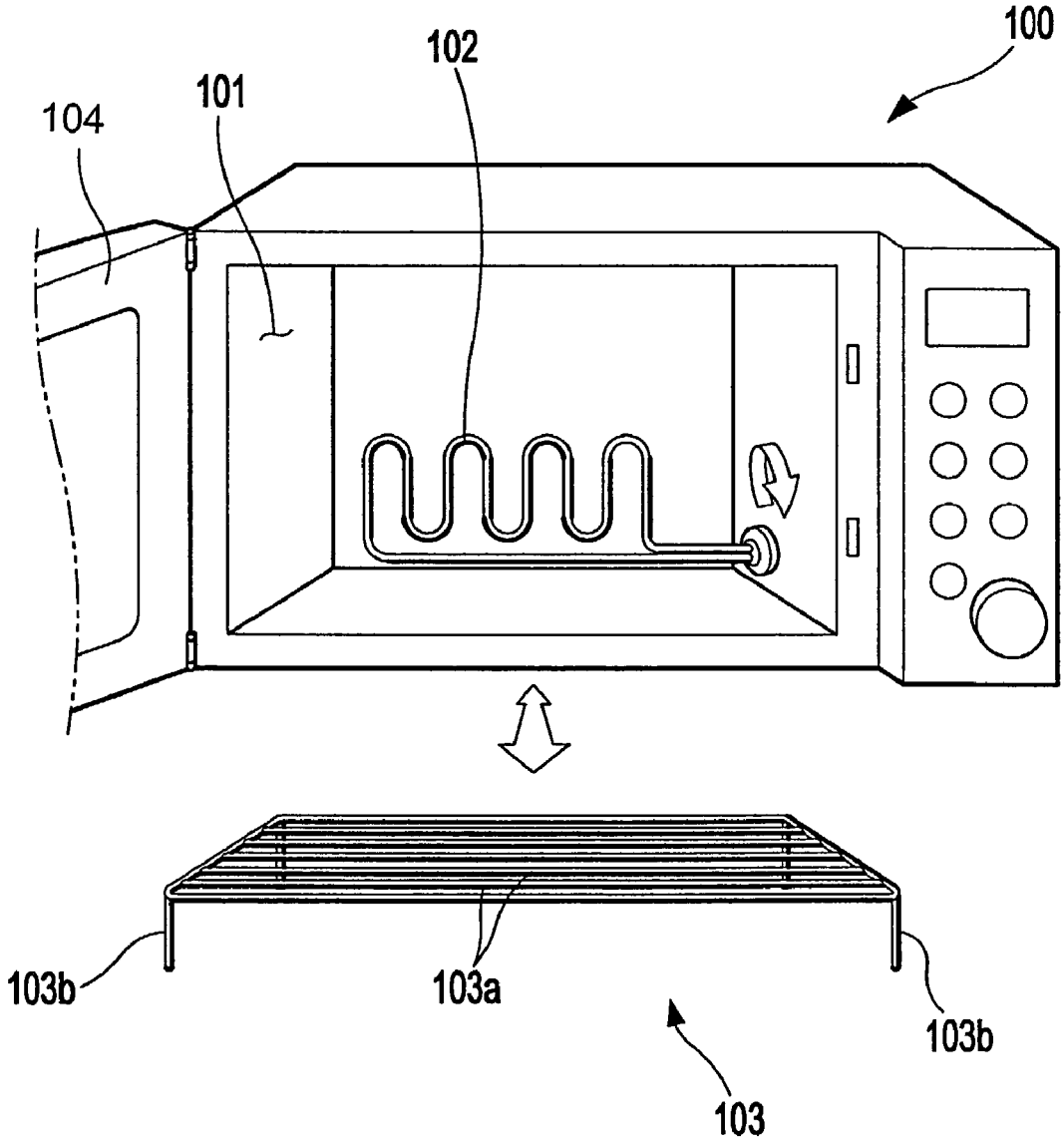
FIG. 1 PRIOR ART
FIG. 1 is a perspective view illustrating a conventional rack for microwave ovens, and a microwave oven using the rack.

Reference will now be made in detail to the present preferred embodiments of the present invention, examples of which are illustrated in the accompanying drawings, wherein like reference numerals refer to like elements throughout.

Figure 2:
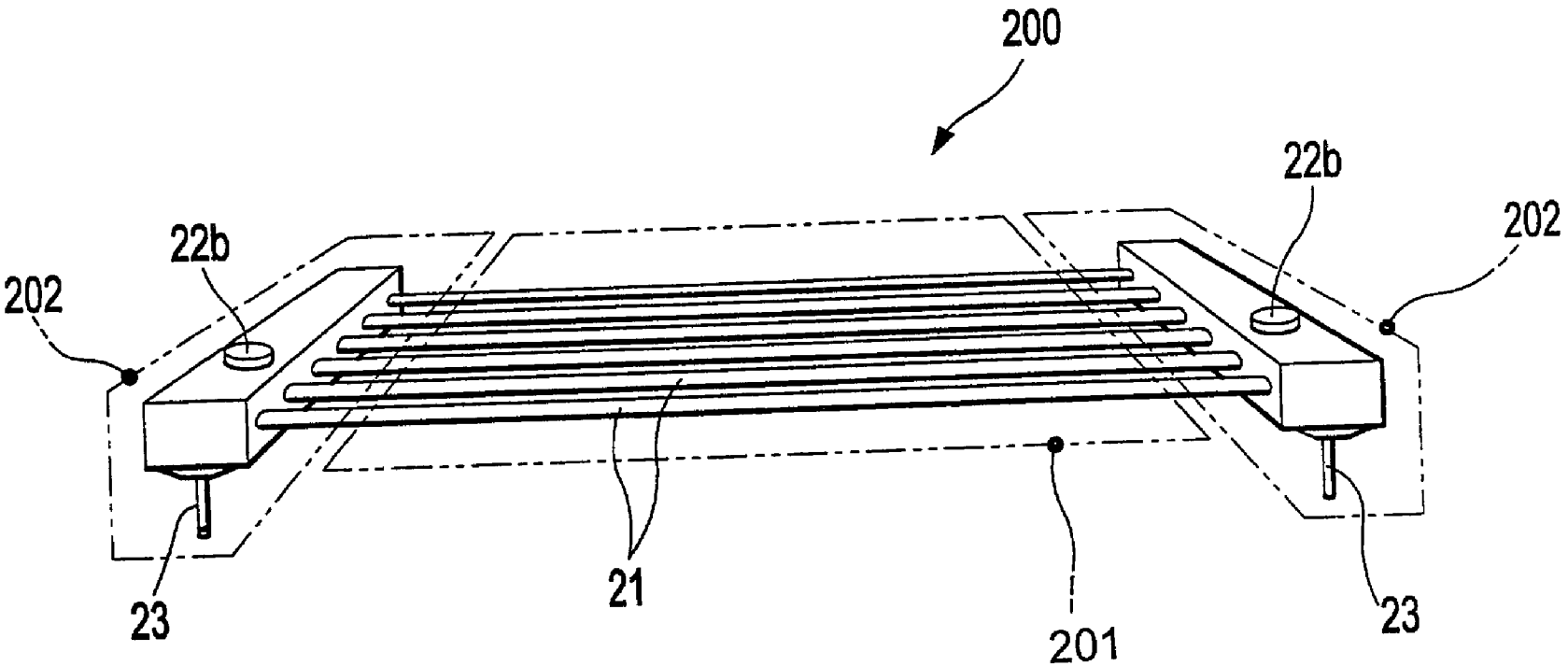
FIG. 2 is a perspective view illustrating a rack for microwave ovens, according to an embodiment of the present invention.

FIG. 2 is a perspective view illustrating a rack 200, according to an embodiment of the present invention. As shown in FIG. 2, the rack 200 includes a rack section 201 to support food thereon. The rack 200 also includes support sections 202 to support the rack section 201 such that the rack section 201 is spaced apart from a bottom of a cooking chamber of a microwave oven by a desired distance when the rack 200 is disposed in the cooking chamber.

The rack section 201 includes a plurality of hollow tubes 21 arranged in parallel while being uniformly spaced apart from one another. Each of the hollow tubes 21 is made of stainless steel and supported by the support sections 202 at opposite ends thereof, respectively. The support sections 202 are described with respect to FIGS. 2 and 3.

Figure 3:
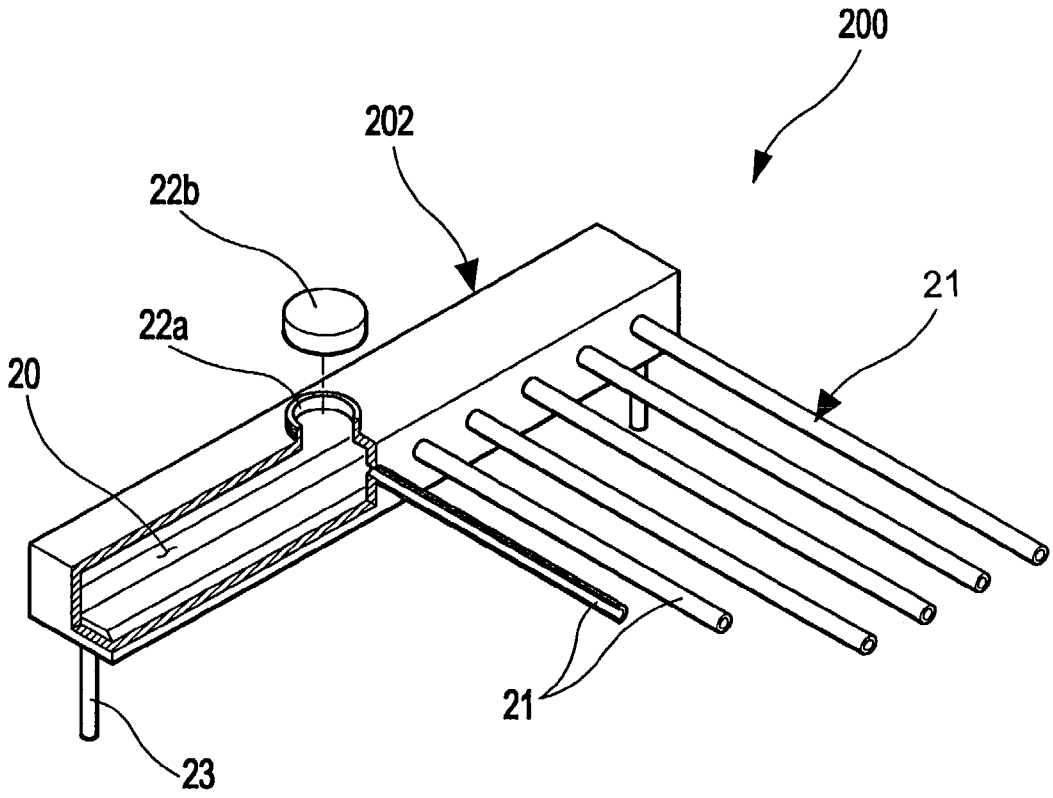
FIG. 3 is a perspective view illustrating an interior of a rack support section as shown in FIG. 2.

FIG. 3 is a perspective view illustrating an interior of a rack support section 202. As shown in FIG. 3, the support section 202 is defined therein with a liquid reservoir 20 to contain a liquid. The liquid reservoir 20 communicates with all of the hollow tubes 21 so as to allow the liquid to flow through the hollow tubes 21. In FIG. 2, a liquid inlet 22*a* is formed at a top portion of each of the support sections 202 in order to put the liquid into the liquid reservoir 20 of the support section 202. A plug 22*b* is also provided to open and close the liquid inlet 22*a*. Support legs 23 are fixedly mounted to a bottom portion of each of the support sections 202 such that they extend downwardly from the support section 202.

As shown in FIG. 2, the configuration including the liquid reservoir 20 to contain the liquid, the liquid inlet 22*a* to put the liquid into the liquid reservoir 20, and the plug 22*b* to open and close the liquid inlet 22*a* is provided at each of the support sections 202, respectively, to support opposite ends of each of the hollow tubes 21. However the present invention is not limited to this embodiment. The configuration including the liquid reservoir 20, the liquid inlet 22*a*, and the plug 22*b* may be provided at only one support section 202 as shown in FIG. 3, so that the present invention is still accomplished. Also, the support sections 202 may be configured only to serve as a supporting unit to simply support the rack section 201. In this case, each of the hollow tubes 21 of the rack section 201 is configured in a form of a tube closed at opposite ends thereof while containing a liquid therein. Accordingly, the present invention may still be accomplished.

Figure 4:
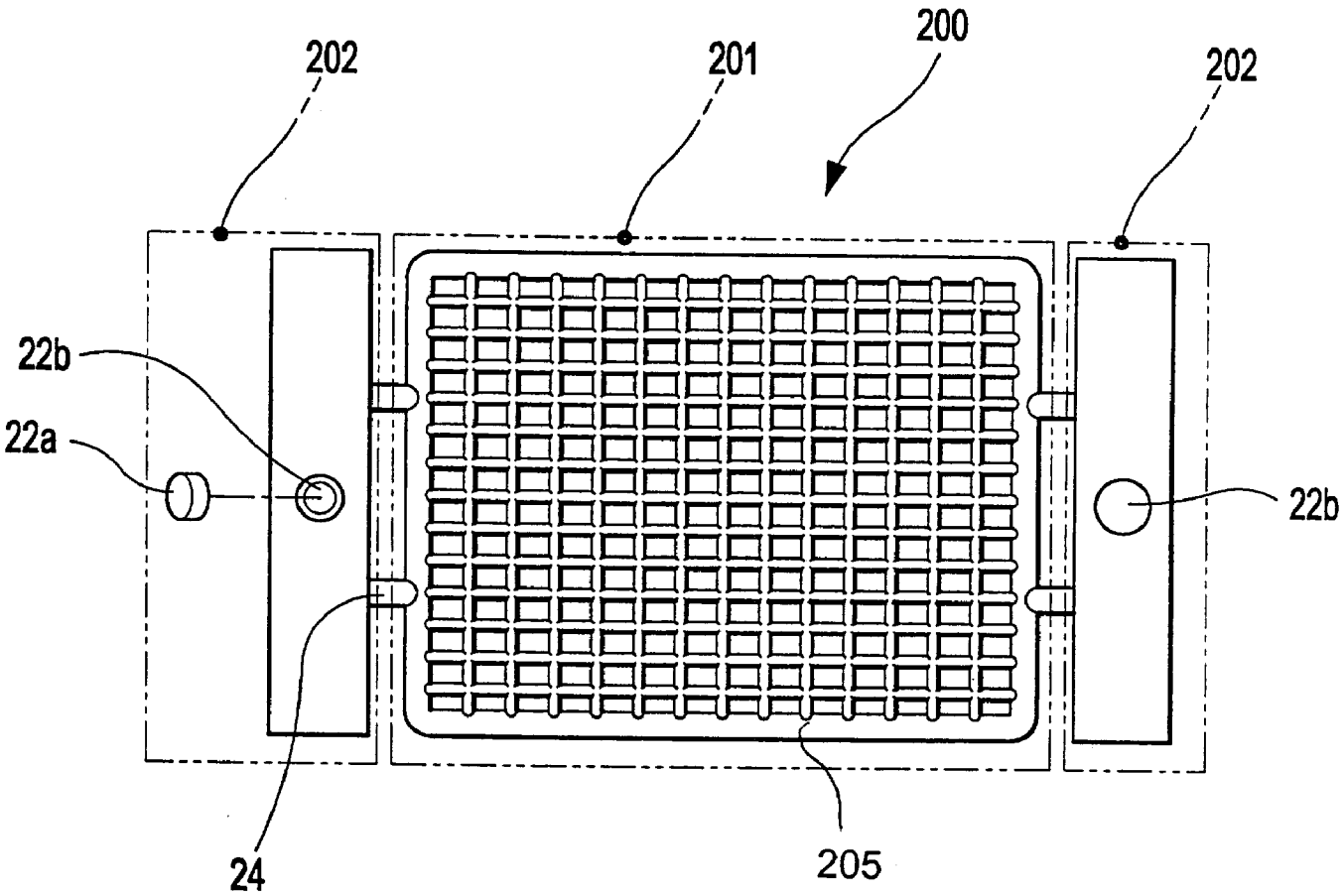
FIG. 4 is a perspective view illustrating a rack for microwave ovens, according to another embodiment of the present invention.

FIG. 4 is a perspective view of a rack for microwave ovens, according to another embodiment of the present invention. As shown in FIG. 4, the rack section 201 includes a hollow net tube 205. The hollow net tube 205 is connected at opposite lateral ends thereof to respective support sections 202 by connecting tubes 24, so that the liquid received in the liquid reservoir of each of the support sections 202 flows through the hollow net tube 205.

Where it is desired to use the rack 200 of the present invention as illustrated in FIGS. 2, 3 and 4, the plug 22*b* is separated from the liquid inlet 22*a* formed at the top portion of one of the support sections 202 to put a liquid into the liquid reservoir 20 of the support section 202 through the liquid inlet 22*a*. Here, the liquid may be put into the liquid reservoir 20 in a sufficient amount without any liquid overflow. Thereafter, the liquid inlet 22*a* is closed by the plug 22*b*. Subsequent use of the rack 200 of the present invention may be carried out in the same manner as that of the conventional rack. Also, a liquid other than water may be used, taking into consideration the burning point of the food being cooked. Sugar or salt-dissolved water may also be used. A selection of an appropriate liquid is made based on a temperature at which the rack section 201 becomes overheated. A preferable liquid is a liquid which allows the rack section 201 to be heated to a temperature at which the food is well heated without being burnt. Putting the liquid into the liquid reservoir 20 may be carried out by a user. Alternatively, liquid may be put into the liquid reservoir 20 at a manufacturing stage of the product. The liquid put in the liquid reservoir 20 may be replaced by another liquid in accordance with the user's desire.

Generally, water may be used as the liquid of the liquid reservoir. However, where the rack section of the rack is made of iron, and plated with nickel or chromium, it may corrode at its portion contacting the water. As a result, life of the rack may be shortened. In order to eliminate such a problem, the rack section 201 of the rack 200 according to the present invention is made of stainless steel having no possibility of corrosion. The present invention may be accomplished even when a material other than stainless steel, for example, a material having a low possibility of corrosion, such as aluminum, or a material exhibiting no corrosion while having a high heat resistance, is used.

Figure 5:
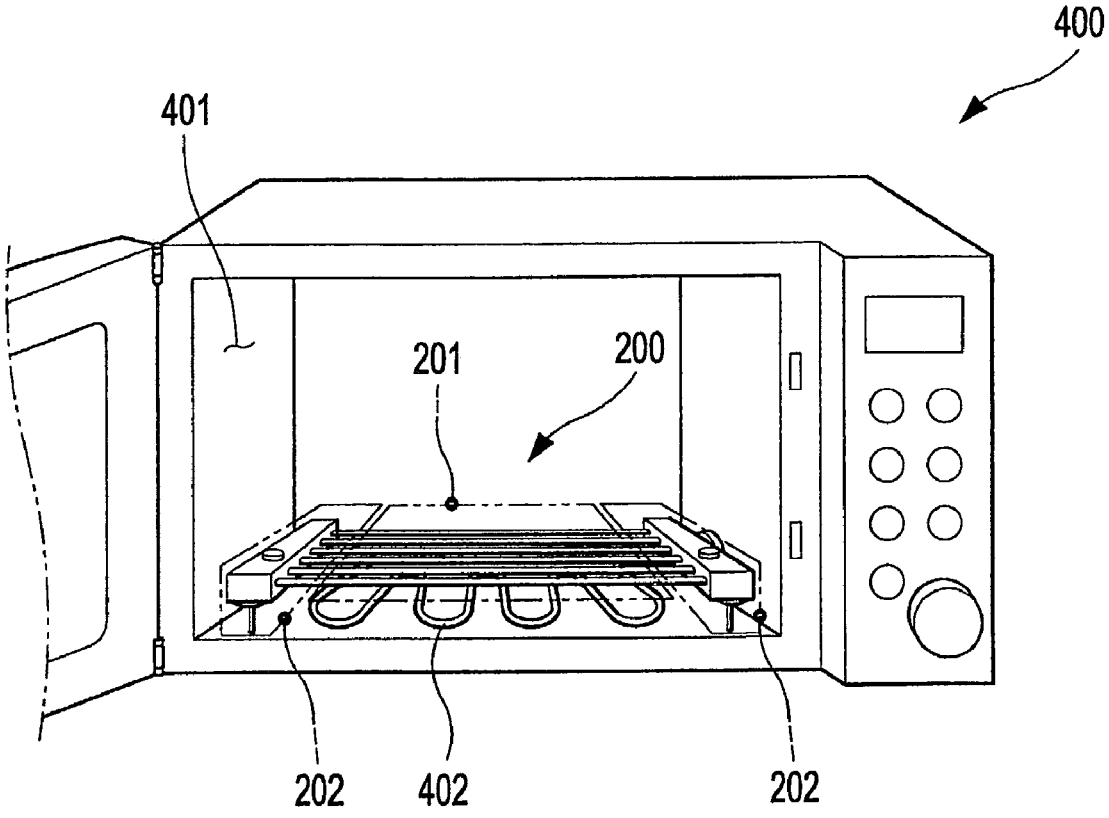
FIG. 5 is a perspective view illustrating a microwave oven set equipped with a heater and a rack, according to an embodiment of the present invention.

The present invention also provides a microwave oven set characterized in that it is equipped with the rack having the above described configuration, according to the present invention. FIG. 5 is a perspective view illustrating a microwave oven set 400, according to an embodiment of the present invention. As shown in FIG. 5, the microwave oven set 400 includes a cooking chamber 401, a rotatable heater 402 installed in the cooking chamber 401, and the rack 200 described in FIG. 2 above. The heater 402 is disposed in a back side portion of the cooking chamber 401 when the heater 402 is not used, and is disposed at a lower portion of the cooking chamber 402 when the heater 402 is used. The rack 200 includes the rack section 201 to support food thereon and is provided above the heater 402 when the heater 402 is used. The rack 200 also includes the support sections 202 to support the rack section 201 so that the rack section 201 is spaced apart from a bottom of the cooking chamber 401 of the microwave oven by a desired distance when the rack 200 is disposed in the cooking chamber 401.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A rack for a microwave oven including a rack section to support food thereon, and support sections to support the rack section, the rack being disposed in a cooking chamber defined in the microwave oven, the rack comprising:

a plurality of hollow tubes provided in the rack section and containing a liquid therein to prevent food on the rack section from being burnt.

2. The rack according to claim 1, wherein, the plurality of hollow tubes are arranged in parallel, and the support sections support opposite ends of each of the hollow tubes, respectively, and at least one of the support sections is defined therein with a liquid reservoir to contain the liquid which flows through the hollow tubes.

3. A rack for a microwave oven including a rack section to support food thereon, and support sections to support the rack section, the rack being disposed in a cooking chamber defined in the microwave oven, the rack comprising:

a hollow net tube provided in the rack section, and containing a liquid therein to prevent food from the rack section from being burnt.

4. The rack according to claim 3, wherein the support sections support opposite lateral ends of the hollow net tube, respectively, and at least one of the support sections is defined therein with a liquid reservoir to contain the liquid which flows through the hollow net tube.

5. The rack according to claim 1, wherein the hollow tubes are made of a material free of corrosion.

6. The rack according to claim 3, wherein the hollow net tube is made of a material free of corrosion.

7. The rack according to claim 5, wherein the material free of corrosion is stainless steel.

8. The rack according to claim 6, wherein the material free of corrosion is stainless steel.

9. The rack according to claim 2, wherein the at least one of the support sections includes a liquid inlet to put the liquid into the liquid reservoir, and a plug to open and close the liquid inlet.

10. The rack according to claim 4, wherein the at least one of the support sections includes a liquid inlet to put the liquid into the liquid reservoir, and a plug to open and close the liquid inlet.

11. A microwave oven set equipped with the rack according to claim 1.

12. A microwave oven set equipped with the rack according to claim 3.

13. A rack disposed in a cooking chamber of a microwave oven equipped with a heater, comprising:

a rack section to support food;

support sections to support the rack section so that the rack section is spaced apart from a bottom of the cooking chamber; and a plurality of hollow tubes provided in the rack section, and containing a liquid therein to prevent food on the rack section from being burnt.

14. The rack according to claim 13, wherein the plurality of hollow tubes are arranged in parallel, and receive the liquid from the support sections.

15. The rack according to claim 14, wherein the support sections support opposite ends of each of the hollow tubes, and are defined therein with a liquid reservoir to contain the liquid which is received in and flows through the hollow tubes.

16. The rack according to claim 15, wherein the support sections comprise:

a liquid inlet provided at a top portion thereof to put the liquid into the liquid reservoir of the support section;

a plug to open and close the liquid inlet; and support legs extended downward and fixedly mounted to a bottom portion thereof to support the support section.

17. The rack according to claim 13, wherein at least one of the support sections is defined therein with a liquid reservoir to contain the liquid which flows through the hollow tubes.

18. The rack according to claim 13, wherein the support sections are provided at opposite ends of the hollow tubes to support the rack section, and the hollow tubes are closed at the opposite ends to contain the liquid therein.

19. The rack according to claim 13, wherein the hollow tubes are made of stainless steel or aluminum.

20. A rack disposed in a cooking chamber of a microwave oven equipped with a heater, comprising:

a rack section to support food;

support sections to support the rack section so that the rack section is spaced apart from a bottom of the cooking chamber; and a hollow net tube provided in the rack section, and containing a liquid therein to prevent food on the rack section from being burnt.

21. The rack according to claim 20, wherein the support sections support opposite ends of the hollow net tube, and are defined therein with a liquid reservoir to contain the liquid which is received in and flows through the hollow net tube.

22. The rack according to claim 21, wherein the support sections comprise:

a liquid inlet provided at a top portion thereof to put the liquid in to the liquid reservoir of the support section;

a plug to open and close the liquid inlet; and support legs extended downward and fixedly mounted to a bottom portion thereof to support the support section.

23. The rack according to claim 20, wherein at least one of the support sections is defined therein with a liquid reservoir to contain the liquid which flows through the hollow net tube.

24. The rack according to claim 20, wherein the support sections are provided at opposite ends of the hollow net tube to support the rack section, and the hollow net tube is closed at the opposite ends to contain the liquid therein.

25. The rack according to claim 20, wherein the hollow net tube is made of stainless steel or aluminum.

26. A rack disposed in a cooking chamber of a microwave oven equipped with a heater, comprising:

a rack section to support food;

support sections to support the rack section so that the rack section is spaced apart from a bottom of the cooking chamber; and a hollow tubular portion provided in the rack section, and containing a liquid therein to prevent food in the rack section from being burnt.

* * * * *

UNITED STATES PATENT AND TRADEMARK OFFICE

CERTIFICATE OF CORRECTION

PATENT NO. : 7,009,160 B2
APPLICATION NO. : 10/351996
DATED : March 7, 2006
INVENTOR(S) : Dae-Sung Han et al.

It is certified that error appears in the above-identified patent and that said Letters Patent is hereby corrected as shown below:

Column 4, line 48, Claim 3, after “section”, delete “,”;

Column 4, line 49, Claim 3, replace “from” with --on--, therefor;

Column 6, line 39, Claim 26, replace “in” with --on--, therefor.

Signed and Sealed this

Twenty-second Day of August, 2006

JON W. DUDAS
*Director of the United States Patent and Trademark Office*